United States Patent [19]

Rich et al.

[11] 4,320,269

[45] Mar. 16, 1982

[54] VACUUM INTERRUPTER WITH INCREASED SEPARATION OF FUNCTIONS

[75] Inventors: Joseph A. Rich, Schenectady; James J. Carroll, Clifton Park, both of N.Y.

[73] Assignee: Electric Power Research Institute, Inc., Palo Alto, Calif.

[21] Appl. No.: 60,586

[22] Filed: Jul. 25, 1979

[51] Int. Cl.[3] ..... H01N 33/66

[52] U.S. Cl. ..... 200/144 B

[58] Field of Search ..... 200/144 B

[56] References Cited

U.S. PATENT DOCUMENTS

| | | | |
|---|---|---|---|
| 3,469,048 | 9/1969 | Lee et al. | 200/144 B |
| 3,679,474 | 7/1972 | Rich | 200/144 B |
| 3,798,484 | 3/1974 | Rich | 200/144 B |
| 3,970,810 | 7/1976 | Carroll et al. | 200/144 B |
| 4,063,126 | 12/1977 | Rich et al. | 200/144 B |

*Primary Examiner*—Robert S. Macon

*Attorney, Agent, or Firm*—Flehr, Hohbach, Test, Albritton & Herbert

[57] ABSTRACT

The invention provides a vacuum interrupter with improved separation of functional elements. The interrupter includes separable contacts for carrying continuous current and rod electrode arrays for carrying fault currents. The housing for the interrupter is evacuated, and has a plurality of interior chambers. The rod electrodes are in one chamber and the separable contacts are in an adjacent chamber. A communicating opening is provided between the chambers. The rod electrodes and separable contacts are connected in parallel in a common circuit. When the contacts are separated, arcing products are conveyed to the adjacent chamber through the communicating opening to initiate arcing between the rod electrodes.

18 Claims, 4 Drawing Figures

VACUUM INTERRUPTER WITH INCREASED SEPARATION OF FUNCTIONS

The present invention relates generally to vacuum current interrupters of the type capable of interrupting large currents, and more particularly to interrupters which incorporate rod array arcing surfaces.

Increased demand for electric power requires utilities to enlarge power distribution systems and to increase the operating voltages of power transmission lines. As the capacity of power systems is enlarged, there is a continuing need in the electric power industry for improved circuit interrupting devices.

Interruption of large currents using separable contacts is best accomplished in a strong dielectric environment. Enclosing the contacts in a vacuum bottle is one well known technique for increasing the dielectric strength of the gap between the contacts. It is also necessary to protect the contacts against premature destruction from excessively concentrated arcing. For this purpose, arc surfaces are often provided. One type of interrupter, shown in Rich, U.S. Pat. No. 3,679,474, incorporates separable contacts and a rod array diffuse arc electrode structure in a single bottle. A similar type of interrupter is found in Rich and Westendrop, U.S. Pat. No. 4,063,126. In both interrupters, current is carried by the closed contacts until circuit isolation is called for, at which time the contacts are opened and an arc initiates. The arc is transferred to the surrounding rod array electrode structure which is specifically designed to carry the fault current without suffering damage.

The interrupters described in U.S. Pat. Nos. 3,679,474 and 4,063,126 incorporate elements which perform essentially different functions in the same bottle. The separable contacts carry the continuous current and initiate the arc. The rod array diffuse arc electrode structure carries the fault current. The functionally distinct elements are in close proximity to one another to allow the arc to be transferred from the contacts to the rod electrodes. The proximity has disadvantages, however. Most serious is the problem of metal splatter which forms deposits on the rod electrodes. These deposits significantly affect the dielectric strength of the interrupter. Theoretically, it would be best to place the functionally distinct elements in separate bottles connected in parallel, with the separable contacts in one device carrying the continuous current and the rod electrodes in a parallel device. Separating the elements in such a manner would allow each to be optimized separately and would also prevent any interference between their functions. However, one interrupter in two separate bottles, no matter how desirable in principle, is expensive and unwieldly in practice. Consequently, practical prior art interrupters either combine functional elements or closely associate separate elements, with some sacrifice in performance.

It is an object of the present invention to provide a vacuum device for interrupting large currents in which there is a rapid transfer of current from one separate functional element to another.

It is another object of the invention to provide a vacuum device having improved separation of functions in which elements performing separate functions are individually optimized.

Accordingly, a vacuum device is provided, comprising an evacuated enclosure having a plurality of chambers, with a plurality of rod shaped arc surfaces in a first chamber, and a pair of separable contacts in a second chamber. Means in the enclosure define a communicating opening between the chambers. The rod shaped arc surfaces and the separable contacts are connected in a common circuit so that arcing products from arcing between the separable contacts will be conveyed to the first chamber through the communicating opening and will initiate arcing between the rod shaped arc surfaces.

A preferred embodiment of the invention is described in detail below with reference being made to the accompanying drawings, in which.

Figure 1:
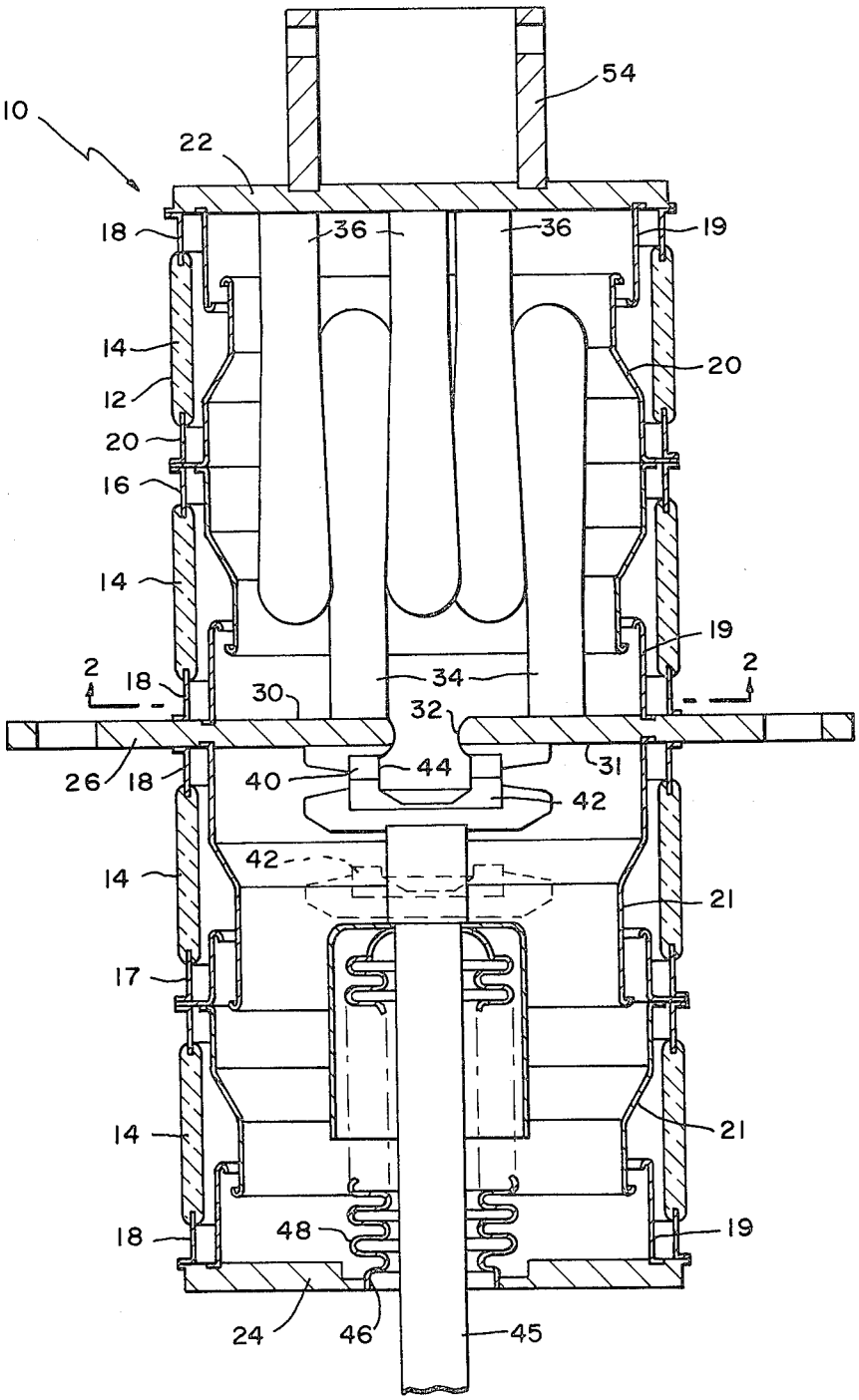
FIG. 1 is a cross sectional view of a vacuum device in accordance with the present invention.

FIG. 1 shows the first embodiment of a vacuum device 10 in accordance with the present invention. The exterior of device 10 is a sealed enclosure 12 having side walls which include a number of cylindrical insulating members 14 formed of glass or a suitable ceramic material. The insulating portions 14 are sealed in any suitable manner to metal wall members 16, 17 and 18. A number of metal vapor shields 19, 20 and 21 are supported in the enclosure to prevent continuous metal vapor deposits from short-circuiting the device, as is well known. The two end walls of the enclosure 22 and 24, and an intermediate wall member 26, are attached with vacuum seals to side wall members 18. The entire enclosure is evacuated to a pressure of approximately $10^{-5}$ torr or less.

The interior of enclosure 12 is divided into a plurality of chambers, including a first chamber 30, and a second chamber 31 adjacent the first chamber. The chambers are separated by intermediate wall member 26 which extends between the side walls of the enclosure. End wall 22 and intermediate wall 26 of the enclosure are metal plates which are electrically conductive, and will be referred to as such hereinafter. First chamber 30 of the enclosure is bounded at opposite ends by end plate 22 and intermediate plate 26. Second chamber 31 is bounded at one end by intermediate plate 26, and by end wall 24. An opening 32 through intermediate plate 26 defines a communicating opening between the first and second chambers of the enclosure.

Mounted within first chamber 30 of enclosure 12 are a plurality of spaced rod electrodes, including a plurality of first rod electrodes 34 supported from intermediate plate 26 and a plurality of second rod electrodes 36 supported from end plate 22. The rod electrodes serve as rod shaped arc surfaces which provide a diffuse arc electrode structure for the interrupter. Rod electrodes 34 and 36 are formed of any suitable vacuum arc electrode material, preferably one which is substantially gas free. The surfaces of the rod electrodes should be smooth for dielectric strength, i.e., the ability to withstand high voltage. In the preferred embodiment, three first rod electrodes and four second rod electrodes are provided (see FIG. 2). The illustrated electrodes have a bulbous or tapered shape which improves performance in accordance with the teaching of U.S. Pat. No. 4,063,126, although other electrode shapes may be employed. Except for the center second rod electrode 36, all the rod electrodes are arranged in circular arrays with first and second rod electrodes alternating to form a ring of spaced first and second rod electrodes. The use of circular arrays of rod electrodes is in accordance with the teaching of U.S. Pat. No. 3,679,474. Since the first rod electrodes are coupled electrically to intermediate plate 26 and the second rod electrodes are coupled electrically to end plate 22, the first and second rod electrodes are electrically isolated from each other and will be of opposite polarity during arcing.

Second chamber 31 contains a pair of separable contacts positioned adjacent opening 32 in intermediate plate 26. The contacts include a first contact 40 and a second contact 42. The first contact is supported by intermediate plate 26 and has an opening 44 formed in the center so that the first contact substantially encircles communicating opening 32. Second contact 42 is supported on an actuating rod or stem 45 which passes through an opening 46 in enclosure end plate 24. A metal bellows 48 sealed to end plate 24 and also to contact stem 45 allows movement of the second contact without disruption of the interior vacuum in enclosure 12. The exterior end of support rod 45 is connected to a suitable actuating means (not shown) for rapidly separating the contacts.

Figure 3:
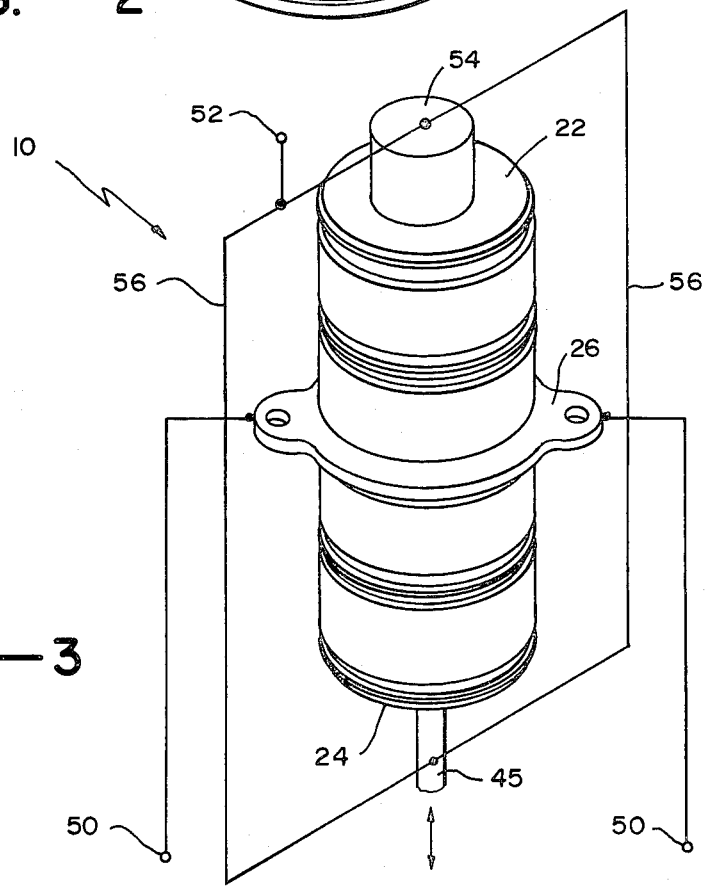
FIG. 3 is a schematic diagram showing the external connections for the interrupter of FIG. 1.

The external connections for interrupter 10 are illustrated in FIG. 3. Terminals of one polarity 50 are connected to intermediate plate 26. A terminal of the opposite polarity 52 is connected to second rod electrodes 36 and second contact 42. The physical connections to terminal 52 are made to a connector 54 mounted on end plate 22, and to contact stem 45. FIG. 3 shows external conductors in a circuit for carrying current between the ends of the device and terminal 52. External conductors 56 are preferably positioned in a plane which intersects the device at right angles to the plane in which terminals 50 are connected to intermediate plate 26. This connection arrangement has been found to balance any effects produced by the external connections on arc transfer in the device. Balancing the conductors as depicted in FIG. 3 is particularly advantageous when the conductors are in close proximity to the device, such as when strip conductors mounted on the outer surface of enclosure 12 are used. Using the wiring pattern shown in FIG. 3, first contact 40 is electrically coupled to first rod electrodes 34, since both are mounted on intermediate plate 26, and second contact 42 is electrically coupled to second rod electrodes 36 by means of external connection 56. Thus, although the two functionally distinct sets of elements (i.e., the rod electrodes and the separable contacts) are disposed in physically separated parts of the device (chambers 30 and 31), both are connected in parallel in a common circuit.

Figure 2:
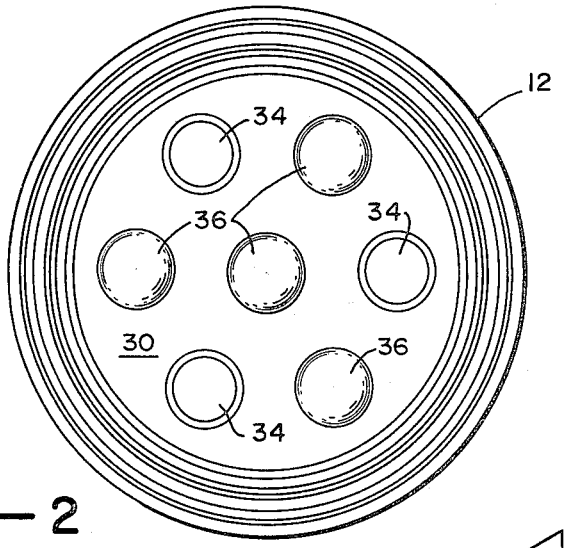
FIG. 2 is a horizontal sectional view taken along line 2—2 of FIG. 1.

In operation, the first embodiment device of FIGS. 1–3 is used to interrupt current on a power line or the like. Power line terminals are connected to external connections 50 and 52. With the contacts closed, current flows freely through the device by way of the contacts. When current isolation is called for, a signal is sent to the external actuator (not shown) coupled to the outer end of actuating rod 45, separating the contacts. Second contact 42 is moved from its closed position, as shown with solid lines in FIG. 1, to an open position, shown in phantom. Following contact separation, an arc arises between contacts 40 and 42. A portion of the arcing products from arcing between the contacts is conveyed into first chamber 30 through communicating opening 32. Because the rod electrodes are in the same circuit as the separable contacts, the voltage which arises between the contacts during arcing will also exist between the first and second rod electrodes. It has been experimentally verified that the arcing products driven into the first chamber through opening 32 will initiate arcing between the rod electrodes. Immediately upon the initiation of arcing in the first chamber between the rod electrodes, it has been found that virtually the entire arc current is diverted from between the separable contacts to the rod electrodes. The rapid diversion of the arc current from the contacts to the rod electrodes is a result of the lower arc voltage of the rod arrays. Assuming the device is used to interrupt an alternating current, arcing will continue until a normal current zero in the alternating current cycle, at which time the arc will disappear. If the dielectric strength between the various gaps in the device is sufficient, arc reignition will be prevented and current interruption will be complete.

The present invention can be used to control large currents associated with power line faults. The portion of the device which performs the function of carrying the normal load current (the separable contacts) is virtually completely separated from the portion of the device which carries the fault current (the rod electrodes). Because the functional elements are not in the same chamber, each can be individually optimized. The rod electrodes can be advantageously positioned relative to each other to obtain maximum arc dispersion and dielectric strength. Metal splatter from the separable contacts is substantially reduced in the present invention for several reasons. High current arcing between the contacts is minimized because of the rapid diversion of the arc current to the rod electrodes after contact separation. Of the arcing products which are generated, only a small fraction enter the vicinity of the rod electrodes, with the remainder being confined to the second chamber of the device. Reduced metallic arcing deposits on the rod electrodes substantially improves their performance, particularly with regard to their ability to withstand high voltage. Contact life is also prolonged because of the reduction in contact arcing. The device also dissipates heat efficiently, with intermediate plate 26 serving as a central heat sink.

Figure 4:
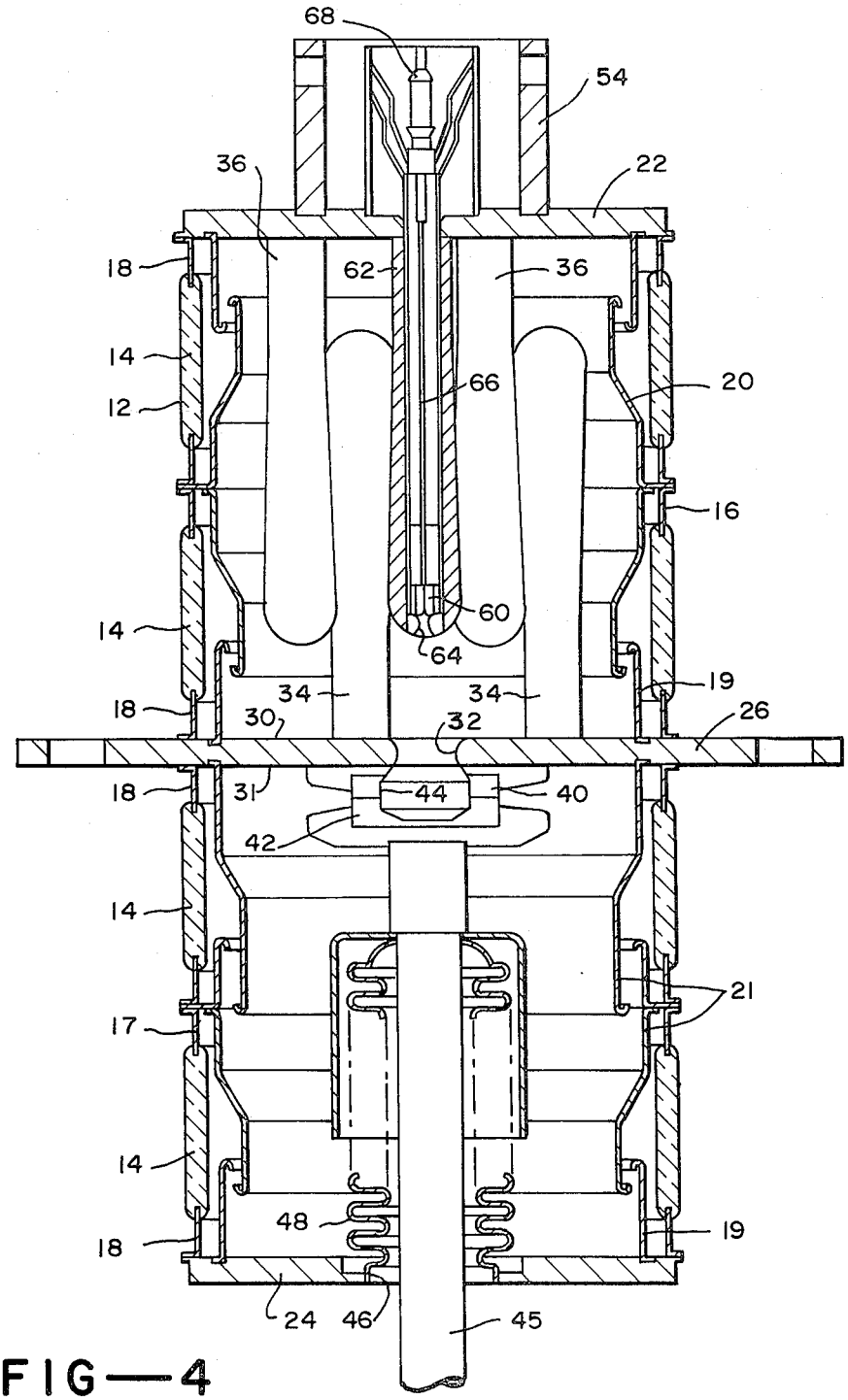
FIG. 4 is a cross sectional view of an alternative embodiment of a vacuum device in accordance with the present invention.

An alternative embodiment of the invention is shown in FIG. 4. The embodiment of FIG. 4 contains substantially all the elements and structural features of the first embodiment, and the same reference numbers are used in FIG. 4 to identify like parts. The only difference between the embodiment of FIG. 4 and the first embodiment is the provision of a plasma trigger device 60 in first chamber 30 to aid in initiating arcing between the rod electrodes. Plasma trigger 60 is installed inside the center second rod electrode 62. An opening 64 is formed in the end of rod electrode 62 to emit the plasma discharge from trigger 60. The plasma trigger device 60 can be of any conventional type. A trigger lead 66 extends through the center of rod electrode 62, and passes through end plate 22 to a suitable external connector 68. A source of trigger current (not shown) is coupled to connector 68 and provides a trigger pulse which causes plasma trigger 60 to emit an electron-ion plasma into first chamber 30.

The embodiment of FIG. 4 is intended primarily for aiding in contact closure. The vacuum device will be connected in a circuit in the manner shown in FIG. 3. Assuming that contacts 40 and 42 are separated and a voltage is applied across terminals 50 and 52, the embodiment of FIG. 4 operates to safely close the contacts. A trigger pulse is supplied to connector 68, firing plasma trigger 60 and injecting an electron-ion plasma into first chamber 30. The plasma initiates arcing between rod arrays 34 and 36, creating an almost instantaneous short circuit. Separable contacts 40 and 42 can then be closed and will carry the continuous current, extinguishing arcing between the rod electrodes. The plasma trigger is also useful where several devices are connected in parallel and the division of current becomes unbalanced during interruption, such as when the arc continues to burn in one device and is extinguished in a parallel device. To prevent overloading the device which remains conductive, the plasma trigger can be used to reestablish the arc in the parallel device. The embodiment of FIG. 4 can also be used to interrupt currents in exactly the same manner as the first embodiment.

The present invention provides a vacuum device for interrupting large currents in which there is a rapid transfer of current from one separate functional element to another. The invention further provides a vacuum device having improved separation of functions in which elements performing separate functions are individually optimized.

What is claimed is:

1. A vacuum device comprising: an evacuated enclosure having a plurality of chambers therein, a plurality of rod shaped arc surfaces in a first said chamber, a pair of separable contacts in a second said chamber adjacent said first chamber, and means defining a communicating opening between said first and second chambers, said rod shaped arc surfaces and said separable contacts being connected in a common circuit wherein arcing products from arcing between said separable contacts will be conveyed to said first chamber through said communicating opening and will initiate arcing between said rod shaped arc surfaces.

2. A vacuum device as in claim 1 in which said rod shaped arc surfaces include a plurality of rod electrodes disposed in spaced side by side relation in said first chamber.

3. A vacuum device as in claim 1 in which said separable contacts are positioned adjacent said communicating opening in said second chamber.

4. A vacuum device as in claim 1 in which one of said separable contacts in said second chamber substantially encircles said communicating opening.

5. A vacuum device comprising: an evacuated enclosure having a plurality of chambers therein, a plurality of spaced rod electrodes in a first said chamber including a plurality of first rod electrodes and a plurality of second rod electrodes, said first and second rod electrodes being unconnected electrically and extending into spaced side by side relation to provide arcing surfaces, first and second separable contacts in a second said chamber adjacent said first chamber, and means defining a communicating opening between said first and second chambers, said first contact being electrically coupled to said first rod electrodes and said second contact being electrically coupled to said second rod electrodes.

6. A vacuum device as in claim 5 in which said separable contacts are positioned adjacent said communicating opening in said second chamber.

7. A vacuum device as in claim 5 in which said first contact in said second chamber substantially encircles said communicating opening.

8. A vacuum device as in claim 5 in which said enclosure includes an intermediate member which is electrically conductive separating said first and second chambers, said first rod electrodes being supported in said first chamber from said intermediate member, and said first contact being supported in said second chamber from said intermediate member.

9. A vacuum device as in claim 8 in which said communicating opening is an opening through said intermediate member.

10. A vacuum device as in claim 8 in which at least some of said first and second rod electrodes are arranged in circular arrays forming a ring of spaced first and second rod electrodes in said first chamber.

11. A vacuum device as in claim 8 including plasma trigger means in said first chamber to aid in initiating arcing between said first and second rod electrodes.

12. A vacuum device as in claim 8 including plasma trigger means in said first chamber to aid in initiating arcing between said first and second rod electrodes.

13. A vacuum device comprising: an evacuated enclosure having a plurality of chambers therein including a first chamber bounded at opposite ends by a boundary member and an intermediate member, both said members being electrically conductive, and a second chamber adjacent said first chamber bounded at one end by said intermediate member, a plurality of spaced rod electrodes in said first chamber including a plurality of first rod electrodes supported from said intermediate member and a plurality of second rod electrodes supported from said boundary member within said first chamber, first and second separable contacts in said second chamber, and an opening through said intermediate member defining a communicating opening between said first and second chambers, said first contact being electrically coupled to said first rod electrodes and said second contact being electrically coupled to said second rod electrodes.

14. A vacuum device as in claim 13 in which said separable contacts are positioned adjacent said communicating opening in said second chamber.

15. A vacuum device as in claim 13 in which said first contact in said second chamber substantially encircles said communicating opening.

16. A vacuum device as in claim 13 in which at least some of said first and second rod electrodes are arranged in circular arrays and form a ring of spaced first and second rod electrodes in said first chamber.

17. A vacuum device as in claim 13 in which said first contact in said second chamber is supported from said intermediate member.

18. A vacuum device as in claim 13 including plasma trigger means in said first chamber to aid in initiating arcing between said first and second rod electrodes.

* * * * *